US005749255A

United States Patent [19]

Arai

[11] Patent Number: 5,749,255

[45] Date of Patent: May 12, 1998

[54] BENDING DEVICE FOR HOLLOW DOUBLE-STRUCTURED PIPE

[75] Inventor: Saburo Arai, Urawa, Japan

[73] Assignees: Sankei Giken Kogyo Kabushiki Kaisya, Tokyo; Kabushiki Kaisya VISTA, Saitama, both of Japan

[21] Appl. No.: 761,829

[22] Filed: Dec. 6, 1996

[51] Int. Cl.[6] ..... B21D 9/04

[52] U.S. Cl. ..... 72/150; 72/370; 29/455.1

[58] Field of Search ..... 72/150, 369, 370; 29/455.1

[56] References Cited

U.S. PATENT DOCUMENTS 4,009,601 3/1977 Shimizu ..... 72/150

FOREIGN PATENT DOCUMENTS 49157 4/1976 Japan ..... 72/150

86059 7/1976 Japan ..... 72/150

*Primary Examiner*—Daniel C. Crane

*Attorney, Agent, or Firm*—Armstrong, Westerman, Hattori, McLeland & Naughton

[57] ABSTRACT

Disclosed is an apparatus for bending a hollow double structured pipe, which is simple in construction, and is capable of putting into practice easily the continuous, two- or three-dimensional bending work. This bending apparatus for the hollow double-structured pipe is of such a construction that a fixed end side of the hollow double-structured pipe is fastened to a bending dies and a fixing dies; an intermediate part of the hollow double-structured pipe is slidably held by a shoe and a pressing dies; then an inner core metal is inserted into an inner pipe, while a tubular core metal is inserted into a gap between the inner pipe and the outer pipe; and the bending dies is rotated in the direction of the pipe-bending to thereby bend the hollow double-structured pipe, wherein a holding member is provided to be commonly butt-contacted to the open end faces of both inner and outer pipes; the holding member and a chuck fixed on the peripheral surface of the outer pipe, at the open end side of the hollow double-structured pipe, are connected each other through a long guide slot formed in the tubular core metal in such a manner that the tubular core metal can be made rotatable with respect to the inner core metal.

1 Claim, 5 Drawing Sheets

BENDING DEVICE FOR HOLLOW DOUBLE-STRUCTURED PIPE

BACKGROUND OF THE INVENTION

1. Field of the Invention

This invention relates to an apparatus for bending the so-called "hollow double-structured" pipe into a curved configuration which can be adapted to the shape and structure of an internal combustion engine and an automobile chassis, the hollow double-structured pipe being composed of an inner pipe and an outer pipe with a space gap being provided between these inner and outer pipes, and having its use as the exhaust pipe to be connected to the internal combustion engine of automobiles, motorbicycles, and so forth.

2. Description of Prior Arts

As the method for bending the hollow double-structured pipe, there has been known a technique, in which the hollow double-structured pipe is fastened, at its one end of the mutually fitted inner pipe and outer pipe and with a space gap being maintained therebetween and this one end of the double pipes being fixed each other, to a bending dies; then, an inner core metal is inserted, from the other end of the double pipe, into the inner pipe, while a tubular core metal is inserted into a space gap between the inner pipe and the outer pipe; and, during the bending work to be effected on the hollow double-structured pipe by rotation of the bending dies, while holding the hollow double-structured pipe on a pressing dies, a holding member is butt-contacted to the open end faces of both inner and outer pipes to thereby prevent both inner and outer pipes from deformation, in particular a longitudinal slipping of the inner pipe with respect to the outer pipe (vide: Japanese Patent Publication No. 55-24971).

The apparatus to implement the above-mentioned bending work is of such a construction that the holding member to hold the end faces of both inner and outer pipes is fixed on the rear end of the pressing dies to cause it to advance in association with rotation of the bending dies. The bending dies and the pressing dies are interlocked with rack and pinion. Accordingly, the apparatus is complicated in structure, and lacks in its smooth operation. In addition, such apparatus is not feasible for its three-dimensional continuous bending work (such as twisting). While it is not impossible to work the continuous, two-dimensional bending, complicated working steps are required to be done at every time the bending work is effected.

With a view to solving the abovementioned various points of problems, the present invention aims at providing an apparatus for bending the hollow double-structured pipe, which is simple in construction, and is capable of easily performing the two- or three-dimensional continuous bending work.

SUMMARY OF THE INVENTION

It is therefore an object of the present invention to provide a pipe bending apparatus of a simplified construction and an improved working efficiency.

According to the present invention, in general aspect of it, there is provided a bending apparatus for a hollow double-structured pipe, wherein a fixed end side of the hollow double-structured pipe is fastened to a bending dies and a fixing dies; an intermediate part of the hollow double-structured pipe is slidably held by a shoe and a pressing dies; then an inner core metal is inserted into an inner pipe, while a tubular core metal is inserted into a gap between the inner pipe and the outer pipe; and the bending dies is rotated in the direction of the pipebending to thereby bend the hollow double-structured pipe, wherein the pipe bending apparatus is so constructed that a holding member is provided to be commonly butt-contacted to the open end faces of both inner and outer pipes; the holding member and a chuck fixed on the peripheral surface of the outer pipe, at the open end side of the hollow double-structured pipe, are connected each other through a long guide slot formed in the tubular core metal in such a manner that the tubular core metal can be made rotatable with respect to the inner core metal.

The foregoing object, other objects as well as the specific details of the present invention will become more apparent and understandable from the following description thereof, when read in conjunction with the accompanying drawing.

BRIEF DESCRIPTION OF THE ACCOMPANYING DRAWING

Figure 2A:
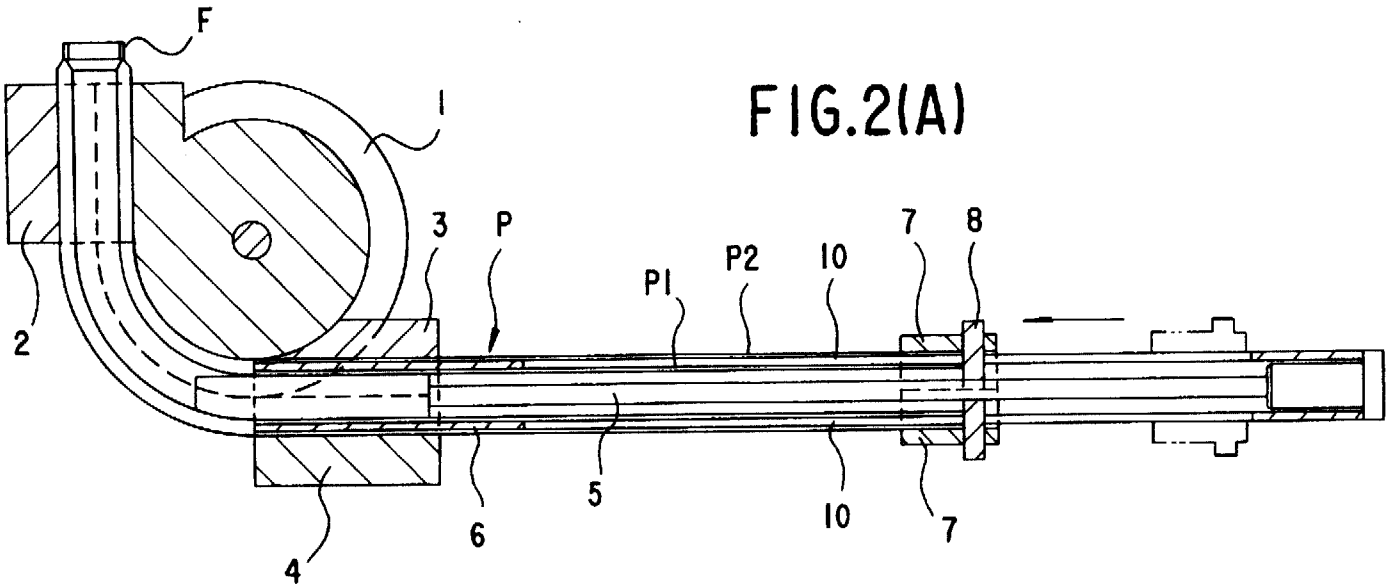
FIG. 2(A) is a front view in longitudinal cross-section showing a state after the bending work has been done.
Figure 2B:
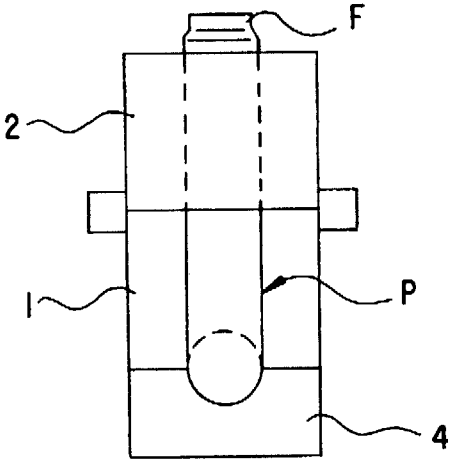
Figure 3A:
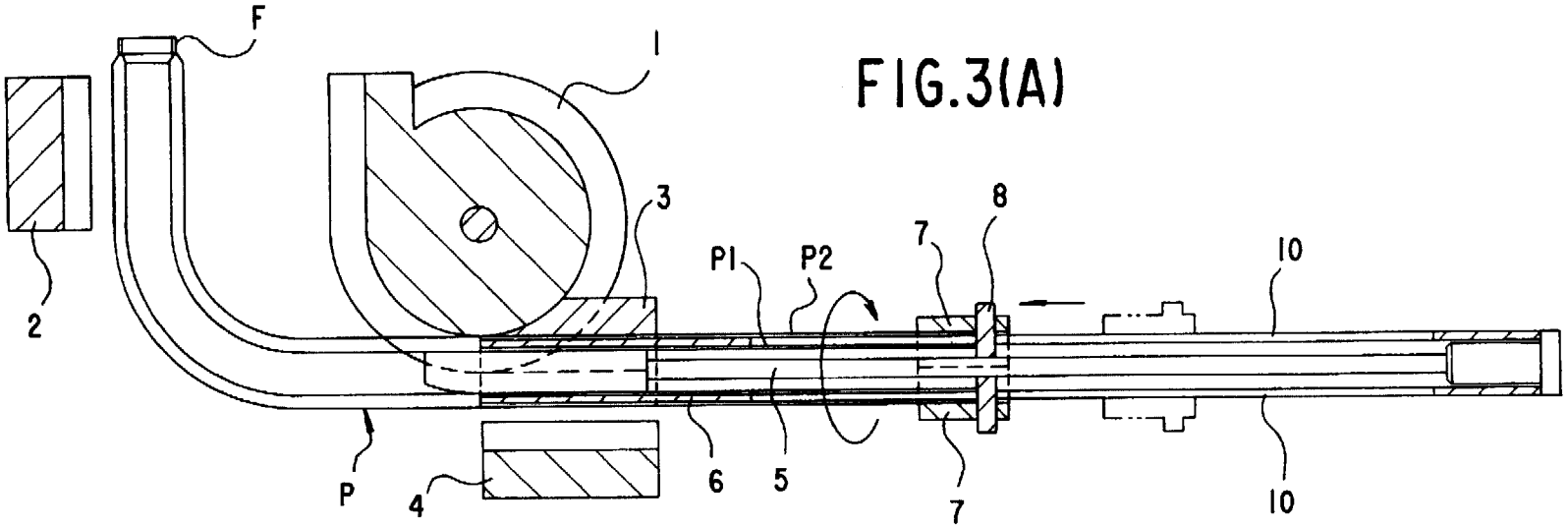
Figure 3B:
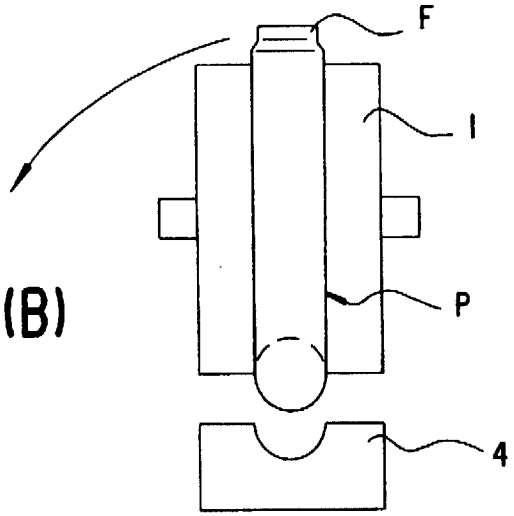
Figure 4A:
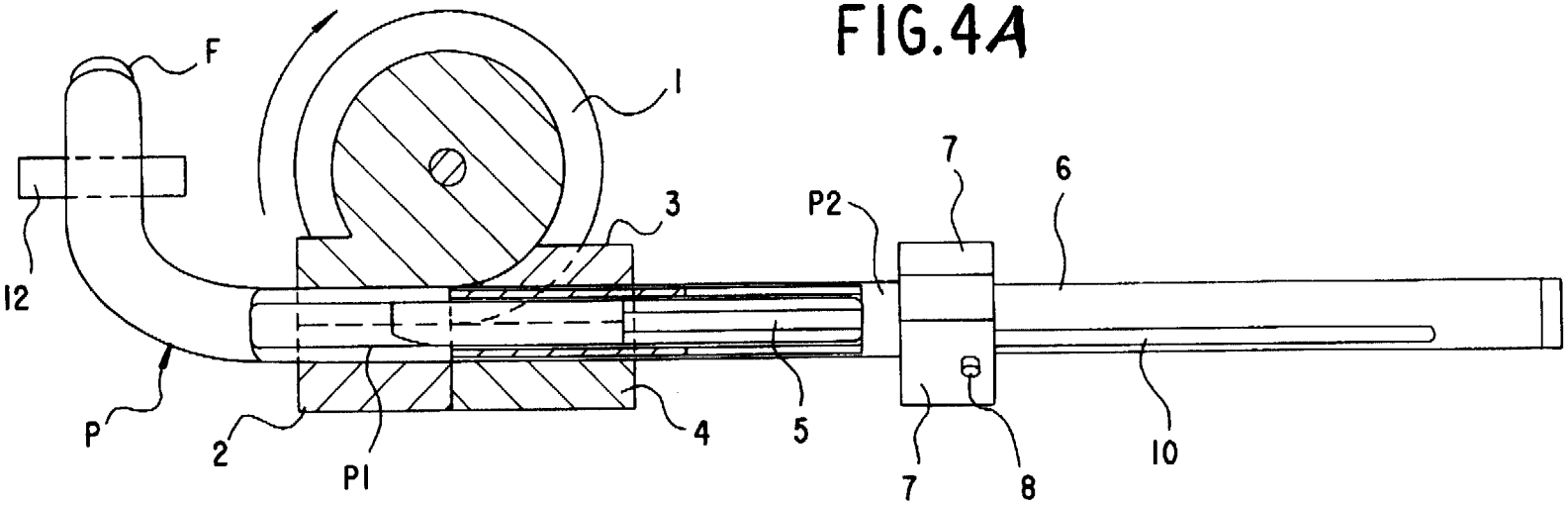
Figure 4B:
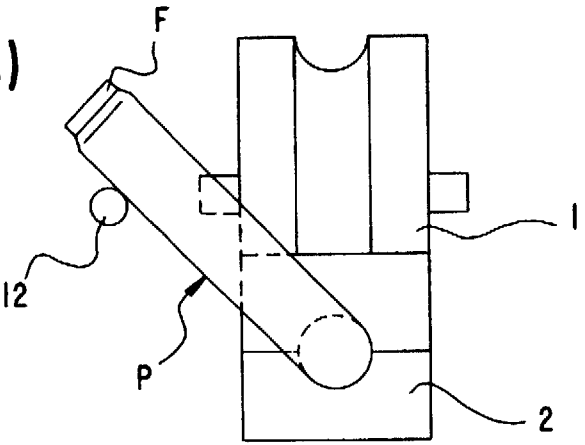

FIG. 2(B). is a left side view of FIG. 2(A);

FIG. 3(A) is a front view in longitudinal cross-section showing a state, wherein the hollow double-structured pipe has been moved to the subsequent bending position;

FIG. 3(B) is a left side view of FIG. 3(A);

FIG. 4(A) is a front view partly in longitudinal cross-section showing a state, wherein the hollow double-structured pipe has been twisted, and before it is undergoing the subsequent bending work;

FIG. 4(B) is a left side view of FIG. 4(A).

Figure 5B:
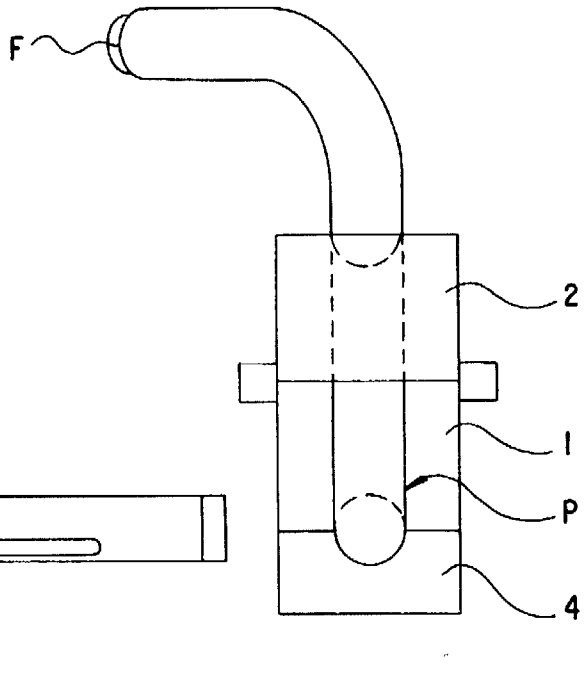
Figure 5A:
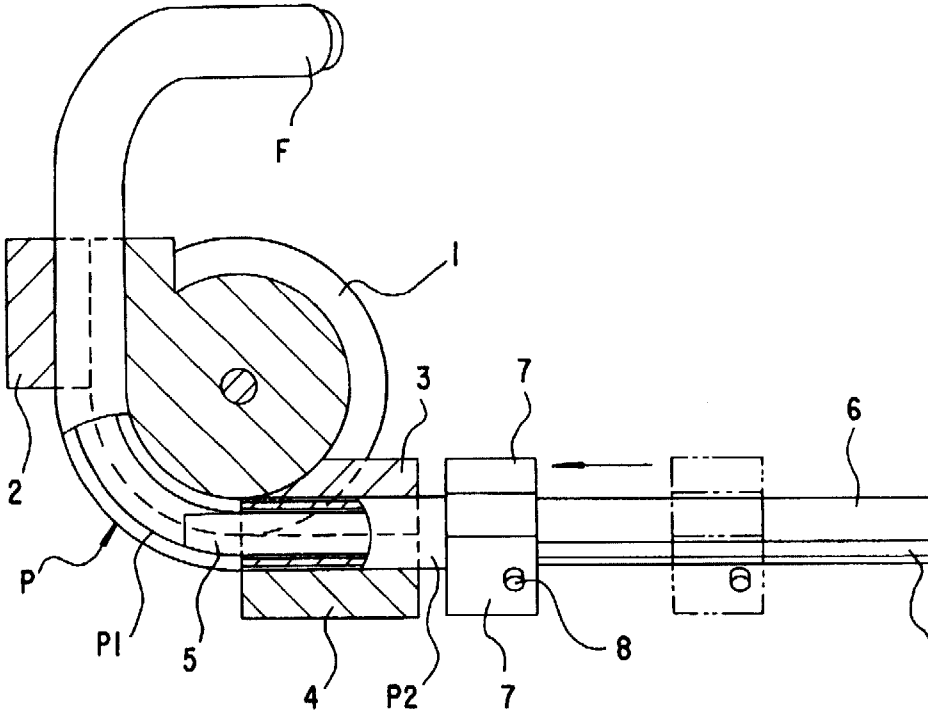

FIG. 5(A) is a front view in longitudinal cross-section showing a state, wherein the hollow double-structured pipe has been moved to the subsequent bending position from that shown in FIG. 4(A);

FIG. 5(B) is a left side view of FIG. 5(A).

DETAILED DESCRIPTION OF PREFERRED EMBODIMENT

In the following, the bending apparatus for the hollow double-structured pipe according to the present invention will be explained specifically in reference to the accompanying drawing.

Figure 1A:
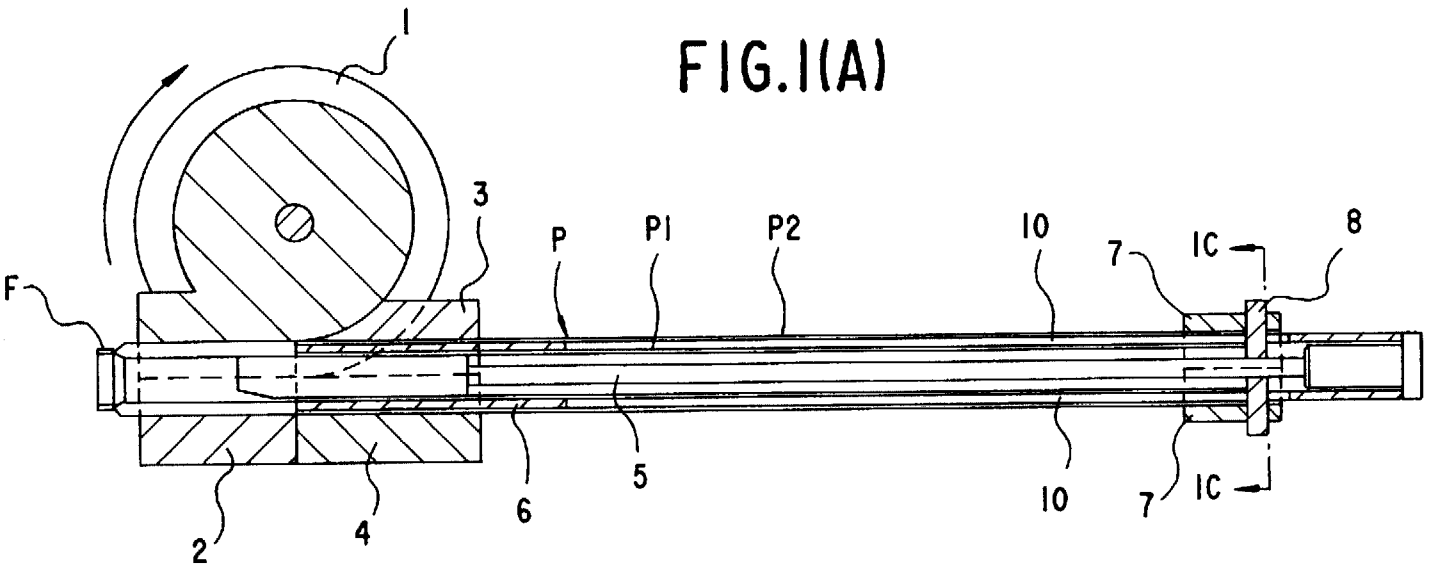
FIG. 1(A) is a front view in longitudinal cross-section showing the bending apparatus according to the present invention, before the start of the bending work.
Figure 1B:
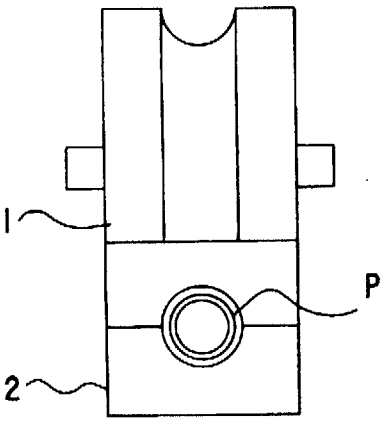
FIG. 1(B) is a left side view of FIG. 1(A)
Figure 1C:
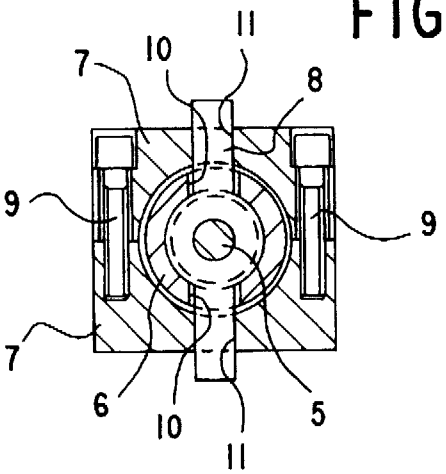
FIG. 1(C) is a cross-sectional view taken along a line c—c in FIG. 1(A)

In FIG. 1, a reference numeral 1 designates a bending dies; a reference numeral 2 designates a fixing dies oppositely disposed with respect to the bending dies 1; a numeral 3 refers to a shoe which is disposed at the rear of, and in contact with, the bending dies 1; a numeral 4 refers to a pressing dies oppositely disposed with respect to the shoe 3; a reference numeral 5 designates an inner core metal to be inserted into the inner pipe P1 of the hollow double-structured pipe P; and a numeral 6 refers to a tubular core metal to be inserted into a space gap between the inner pipe P1 and the outer pipe P2 of the hollow double structured pipe P. The inner core metal 5 and the tubular core metal 6 are coaxially supported in cantilever, the tip end of the inner core metal 5 being in the form of "duckbill". This inner core metal 5 may have various shapes of its tip end. With use of the bending dies 1 and the fixing dies 2, the fixed end side F of the hollow double-structured pipe P is fastened; with use of the shoe 3 and the pressing dies 4, an intermediate part of the hollow double-structured pipe P is slidably held; and, by insertion into the hollow double-structured pipe P of the inner core metal 5 and the tubular core metal 6, followed by rotation of the bending dies over a certain required angle, the hollow double-structured pipe P can be bent. The above-described structure and operations are the same as the conventional working apparatus for bending the hollow double-structured pipe.

The structure to be explained in the following constitutes the characteristic points of the pipe bending apparatus according to the present invention. That is to say, while the inner core metal 5 does not revolve around the axis, the tubular core metal 6 is so supported that it can rotate with the inner core metal 5 as the center. Accordingly, the tip end face of the tubular core metal 6 is perpendicular to the axis.

The open end side of the hollow double-structured pipe P with the core metals 5 and 6 have been inserted thereinto is provided with a split chuck 7 to be fixed on the peripheral surface of the outer pipe P2 and a holding member 8 which is to be applied commonly to the open end face of the inner pipe P1 and the outer pipe P2. The above-mentioned split chuck 7 is of such a construction that, after it is fitted on the peripheral surface of the outer pipe P2, it is tightened and fixed with a pair of bolts 9.

The inner core metal 5 passes through the center part of the above-mentioned holding member 8, which moves freely back and forth along the inner core metal 5. Further, the both end parts of the holding member 8 protrude from the peripheral surface of the tubular core metal 6 through a pair of long guide slots 10, 10, formed along the direction of the generatrixof the tubular core metal 6. The both end parts of the holding member 8 projecting from the long guide slots 10 fitted into a pair of holes 11 which are open to the chuck 7.

As shown in FIG. 1, the hollow double-structured pipe P is gripped, on its open end side, in the bending dies 1, fixing dies 2, the shoe 3, and pressing dies 4. Then, the inner and outer core metals 5, 6 are inserted into the hollow double-structured pipe P, the holding member 8 abutts simultaneously against the open end faces of the inner pipe P1 and the outer pipe P2. In this state, when the chuck 7 is tightened, the holding member 8 is fixed to the outer pipe P2, whereby the butt-contacted state of the holding member 8 with respect to the inner pipe P1 and the outer pipe P2 is maintained.

Subsequently, from the state as shown in FIG. 1, the bending dies 1 is rotated in the required bending direction (vide: arrow mark). That is, the rear end of the hollow double-structured pipe P (i.e., the end face of the open end side of the pipe) is held by the holding member 8 to inhibit slipping of the inner pipe P1 which takes place with the bending; in this state, the hollow double-structured pipe P is pulled toward the dies 1, and subjected to the bending work, as shown in FIG. 2.

In the next place, as shown in FIG. 3, the hollow double-structured pipe P is leberated from its fastened state by the fixing dies 2 and the pressing dies 4, and the hollow double-structured pipe P is then caused to move to the next bending position, after which the hollow double-structured pipe P is rotated at a predetermined twisting angle as shown by an arrow mark.

Subsequently, as illustrated in FIG. 4, the bending dies 1 is returned to its original position, followed by tightening of the fixing dies 2 and the pressing dies 4 to bind the hollow double-structured pipe P in its twisted stated. A reference numeral 12 designates a stopper for limiting its twisting angle.

Further, from the state as shown in FIG. 4, the bending dies 1 is rotated in the predetermined direction (vide: arrow mark), after which the hollow double-structured pipe P is subjected to the second bending work in a state of the inner pipe P1 being controlled against its slipping. The position of this second bending is different from the position of the initial bending work, in its curved surface. In other words, there is performed a three-dimensional continuous bending work.

Thus, in the preceding, explanations have been given as to the three-dimensional continuous bending work. When, however, the two-dimensional continuous bending work is to be done, the working step is such that the hollow double-structured pipe P is not twisted from its state as shown in FIG. 3, but the pipe is directly subjected to the subsequent bending work as shown in FIGS. 4 and 5.

Since the bending apparatus for hollow double-structured pipe according to the present invention is in such construction that a fixed end side of the hollow double-structured pipe is fastened to a bending dies and a fixing dies; then an intermediate part of the hollow double-structured pipe is slidably held by a shoe and a pressing dies; an inner core metal is inserted into an inner pipe, while a tubular core metal is inserted into a gap between the inner pipe and the outer pipe; and the bending dies is rotated in the direction of the pipe-bending to thereby bend the hollow double-structured pipe, the bending apparatus being in such a construction that a holding member is provided to be commonly butt-contacted to the open end faces of both inner and outer pipes; the holding member and a chuck fixed on the peripheral surface of the outer pipe, at the open end side of the hollow double-structured pipe, are connected each other through a long guide slot formed in the tubular core metal in such a manner that the tubular core metal can be made rotatable with respect to the inner core metal, the holding member to be equipped, at the time of the bending work, for preventing the slip of the inner pipe with respect to the outer pipe can simply be fixed onto the outer pipe, without necessity at all for push-in force or pull-out force, from outside, to make the holding member function. Accordingly, the pipe-bending apparatus for the hollow double-structured pipe, equipped with the slip-preventive mechanism of the inner pipe, can be simplified in its structure.

Also, when a hollow double-structured pipe is subjected to the bending work, the slip-preventive member for the inner pipe does not require to re-set the holding member at every bending position, once the holding member is fixed on the outer pipe, hence, Irrespective of the presence or absence of the twisting work on the way of the bending operation, the continuous bending work can be effected smoothly, with the consequence that the working efficiency improves remarkably.

Although, in the foregoing, the present invention has been described with reference to a particular embodiment, it should be understood by those skilled in the art that the invention is not limited to this specific embodiment alone, kbut it is capable of a variety of alternative embodiments within the spirit and scope of the invention as recited in the appended claim.

What is claimed is:

1. An apparatus for bending a hollow double-structured pipe, wherein said hollow double-structured pipe has a fixed end side, an intermediate part, and an inner pipe within an outer pipe such that a gap between said inner pipe and said outer pipe houses a tubular core metal and an inner core metal is housed within said inner pipe, said pipe bending apparatus comprising:

a fixing die;

a bending die located above said fixing die, wherein said fixed end side of said hollow double-structured pipe is fastened to said bending die and said fixing die and said bending die is rotated in a direction in which said hollow double-structured pipe is bent;

a shoe located adjacent said bending die;

a pressing die located below said shoe and adjacent said fixing die, wherein said shoe and said pressing die slidably hold said intermediate part of said double-structured pipe;

a holding member having an end surface in contact with open end faces of both said inner and outer pipes of said hollow double-structured pipe;

a chuck located adjacent to said holding member, wherein said chuck and said holding member are fixed on peripheral surfaces of said outer pipe, at an open end side of said hollow double-structured pipe, and are connected to each other through a long guide slot formed in said tubular core metal of said hollow double-structured pipe in such a manner that said tubular core metal can be made rotatable with respect to said inner core metal.

* * * * *